US012158042B2

(12) United States Patent
Dreier et al.

(10) Patent No.: US 12,158,042 B2
(45) Date of Patent: Dec. 3, 2024

(54) DEVICE AND METHOD FOR REAMING A FLIGHT GAP OF A DRILL FLIGHT

(71) Applicant: BAUER Maschinen GmbH, Schrobenhausen (DE)

(72) Inventors: Robert Dreier, Sandizell (DE); Daniel Reil, Scheyern (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 0 days.

(21) Appl. No.: 18/338,126

(22) Filed: Jun. 20, 2023

(65) Prior Publication Data

US 2023/0417108 A1 Dec. 28, 2023

(30) Foreign Application Priority Data

Jun. 22, 2022 (EP) ..... 22 180 485

(51) Int. Cl.
*E21B 10/44* (2006.01)
*E21B 7/02* (2006.01)
*E21B 7/28* (2006.01)

(52) U.S. Cl.
CPC ..... *E21B 10/44* (2013.01); *E21B 7/027* (2013.01); *E21B 7/28* (2013.01)

(58) Field of Classification Search
CPC combination set(s) only.
See application file for complete search history.

(56) References Cited

U.S. PATENT DOCUMENTS 3,204,287 A * 9/1965 Gronbach ..... E05F 1/1261 74/592

FOREIGN PATENT DOCUMENTS

| | | | | |
|---|---|---|---|---|
| CN | 114046133 B | * | 4/2022 | |
| DE | 3446900 A1 | | 7/1986 | |
| DE | 202008016851 U1 | * | 4/2009 | ..... E02F 3/06 |
| DE | 10 2008 064 180 A1 | | 10/2010 | |
| DE | 202018101237 U1 | * | 7/2019 | ..... E21B 12/06 |
| EP | 3 951 128 A1 | | 2/2022 | |
| JP | S51-4802 A | | 1/1976 | |

(Continued)

OTHER PUBLICATIONS

Chen, Jian, Chinese Patent Publication No. CN114046133, English translation dated May 3, 2023. (Year: 2022).*

(Continued)

*Primary Examiner* — Caroline N Butcher

(74) *Attorney, Agent, or Firm* — Studebaker & Brackett PC

(57) ABSTRACT

A device and method for reaming a flight gap of a drill flight of a drilling tool includes a base carriage displaceably mounted along a mast of a drilling apparatus. A reaming element engages the flight gap so soil adhering to the rotating drilling tool is scraped off by the reaming element. A support arm holding the reaming element is movably mounted between a retracted position where the reaming element is spaced apart from the drilling tool and a reaming position where the reaming element engages the flight gap. The support arm pivots about a pivot axle parallel to a longitudinal drilling axis of the drilling tool. The support arm is additionally mounted on the base carriage parallel to the longitudinal drilling axis of the drilling tool to be deflectable from a basic position, and is resiliently held in the basic position by means of a bias spring.

14 Claims, 9 Drawing Sheets

(56) References Cited

FOREIGN PATENT DOCUMENTS

JP H06-60634 U 8/1994

OTHER PUBLICATIONS

Figure 1:
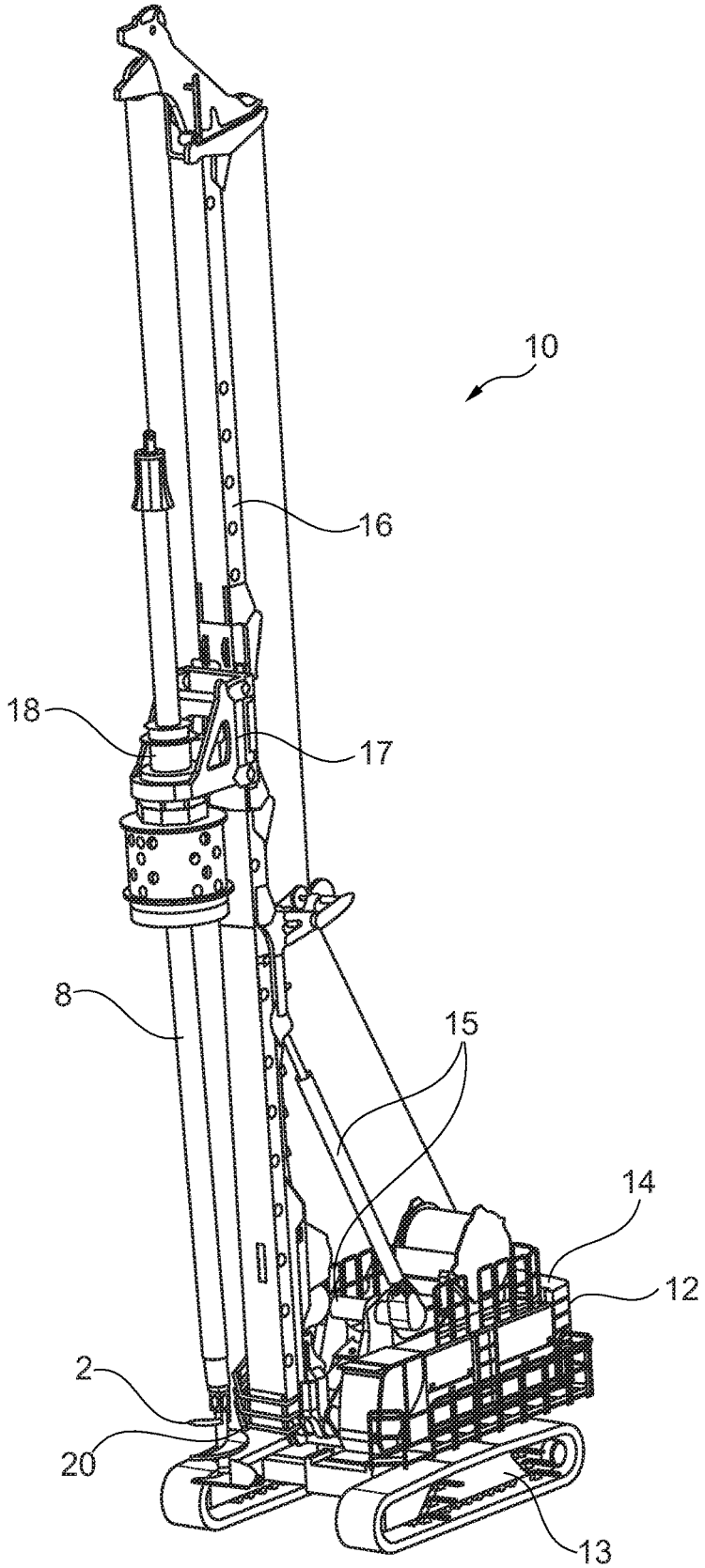

Liebherr-Werk Nenzing, German Patent Publication DE 202018101237 U1, English translation dated May 2, 2024. (Year: 2019).*
Franz, Roman, German Patent Publication DE 102008064180 A1, English translation dated May 3, 2024. (Year: 2010).*
The partial European search report issued by the European Patent Office on Nov. 17, 2022, which corresponds to European Patent Application No. 22180485.9-1002.
The extended European search report issued by the European Patent Office on Dec. 5, 2022, which corresponds to European Patent Application No. 22180485.9-1002.

* cited by examiner

DEVICE AND METHOD FOR REAMING A FLIGHT GAP OF A DRILL FLIGHT

The invention relates to a device for reaming a flight gap in a drill flight of a drilling tool, comprising a base carriage which can be displaceably mounted along a mast of a drilling apparatus, a reaming element which is configured to engage in the flight gap of the drilling tool, wherein soil material adhering to the drilling tool can be scraped off by the reaming element upon rotation of the drilling tool, and a support arm on which the reaming element is held and which is mounted movably relative to the base carriage between a retracted position, in which the reaming element spaced apart from the drilling tool, and a reaming position, in which the reaming element engages in the flight gap for scraping off soil material, according to the preamble of claim 1.

The invention further relates to a method for reaming a flight gap of a drill flight of a drilling tool, in particular a Kelly auger, of adhering soil material, according to the preamble of claim 14.

A generic device for reaming arises, for example, from DE 34 46 900 A1. This device is configured, in particular, for reaming a drilling tool with a relatively short drill flight, in particular a so-called Kelly auger. The device comprises a plate-shaped reaming element on a support arm, which can be pivoted essentially about a horizontal pivot axle between a retracted position, in which the support arm is oriented essentially vertically, and a reaming position, in which the support arm runs approximately horizontally. When the reaming element is engaged with the drill flight, the drill flight must be disengaged from the reaming element by rotation and axial displacement.

When the drilling tool is displaced vertically along a mast on a drilling apparatus, damage can occur to the reaming device if the reaming element is not properly pivoted into the retracted position. Axial shift of the drilling tool with a short auger of a few meters along the mast of a drilling apparatus, which is used, in particular, for creating drilling holes in the ground for foundation piles, occurs relatively frequently due to operating conditions. The risk of possible damage to the device for reaming is correspondingly greater.

EP 3 951 128 A1 discloses device for reaming the drill flight on a so-called continuous flight auger. The reaming device can be moved along the mast via a carriage. Due to the great length of the drill flight in a continuous flight auger, the reaming element is generally always in engagement with the drill flight, so that there is correspondingly less risk of damage if the reaming element swings in or out.

The object underlying the invention is to provide a device and a method for reaming a flight gap of a drill flight, with which a particularly high level of operational safety is achieved.

The object is achieved on the one hand by a device having the features of claim 1 and on the other hand by a method having the features of claim 14. Preferred embodiments of the invention are indicated in the dependent claims.

The device for reaming according to the invention is characterized in that the support arm is pivotably mounted between the retracted position and the reaming position about a pivot axle which is oriented substantially parallel to a drilling longitudinal axis of the drilling tool, in that the support arm is additionally mounted on the base carriage in a direction parallel to the drilling longitudinal axis of the drilling tool so as to be deflectable from a basic position, and in that the support arm is held resiliently in the basic position by means of a bias spring.

A basic idea of the invention lies in that the support arm is mounted so as to be pivotable or deflectable in several directions. Preferably, a resilient mounting is provided for achieving the swinging out or deflecting. Thus, the support arm is initially pivotable between the retracted position and the reaming position about a pivot axle which is oriented substantially parallel to the drilling longitudinal axis. This allows the support arm to be pivoted in and out laterally relative to the drill flight. Compared to a vertical pivoting out, a pivoting movement can thus be carried out without further ado even when the reaming element is already engaged in the drill flight.

The ability to deflect the support arm in the vertical direction can also counteract undesirable bending or damage to the device for reaming or the drill flight. In fact, the support arm with the reaming element has an additional movement clearance to compensate for unexpected axial movements of the drilling tool. For this purpose, the support arm, in particular, is held resiliently in the basic position by means of a bias spring.

A preferred embodiment of the invention is that a basis member and an actuator of the support arm are provided, which is displaceably and adjustably held on the basis member, which is pivotably mounted on the base carriage about the pivot axle. The actuator of the support arm can be regarded as the actual support arm, to the free end of which a preferably plate-shaped reaming element is attached. The rod-shaped actuator can be mounted telescopically in the basis member, which can be configured separately from the support arm or as part of the support arm. In particular, the basis member may be configured tubular, with the rod-shaped actuator being held within the tubular basis member so as to be linearly displaceable and thus is held adjustable in length. By means of a resilient mounting, the actuator can in principle also be held in the basis member in a resiliently linearly adjustable manner.

In principle, the support arm can be pivoted manually. According to a further development of the invention, it is particularly useful that the support arm can be adjusted between the retracted position and the reaming position by means of an actuating element, in particular a hydraulic cylinder. The adjusting movement can thus be carried out by a machine operator, in particular, from a cabin of a corresponding drilling apparatus.

It can be particularly advantageous in this case that the actuating element is arranged on the base carriage and connected to the support arm via a lever mechanism. The lever mechanism can thus be used to achieve a desired transmission and movement, in particular with sufficient articulation and deflectability of the support arm relative to the actuating element.

The lever mechanism can be configured in basically any suitable way to perform the adjustment function. A preferred embodiment is that the lever mechanism comprises a guide lever, which is connected in an articulated manner on the one hand to the base carriage and on the other hand to the piston of the actuating element and a coupling lever, which is articulated on the one hand to the piston and/or to the guide lever and on the other hand to the support arm via a coupling joint. This lever mechanism allows, on the one hand, a good translation of a (linear) actuating movement of the actuating element into a pivoting movement. By linking a coupling lever to the support arm via a coupling joint, on the one hand a good transmission of the pivot movement and on the other hand sufficient deflectability of the support arm, in particular, in the direction of the drilling longitudinal axis, can be achieved.

The coupling joint may, for example, comprise a Cardan joint, a ball joint or other multiaxis joint. According to a further development of the invention, it is particularly expedient that the coupling joint between the support arm and the coupling lever comprises a joint pin, which is linearly displaceably mounted in an elongated hole on the support arm. The elongated hole can be formed in this regard, in particular, parallel to a longitudinal axis of the support arm. This achieves a longitudinally displaceable linkage of the coupling lever to the support arm.

According to a further variant of the invention, it is particularly expedient for the joint pin to be resiliently mounted in the elongated hole. The resilient mounting can be achieved by means of an elastic element, for example a rubber element, or, in particular, one or more springs. In this case, the at least one spring can be arranged along the elongated hole.

In principle, the support arm can be configured in one or multiple parts. A particularly advantageous embodiment of the invention is that the actuator of the support arm is mounted on the base member so as to be pivotable about a deflection axis which is oriented transversely to the drilling longitudinal axis. Therefore, the actuator of the support arm is pivotally mounted about the transversely oriented, in particular horizontally oriented, deflection axis. This allows the support arm with the reaming element arranged thereon to follow an axial movement of the drilling tool to a certain extent without causing undesirable deformations or damage to the device for reaming or on the drill flight.

According to a further embodiment of the invention, it is preferred that the bias spring is arranged between the base member and the actuator of the support arm. Thus, a pivotable base member can be provided, while the deflectability is achieved by the actuator with a corresponding joint and the bias spring relative to the base member.

The base carriage of the device for reaming is in particular mounted so as to be longitudinally displaceable, in particular vertically displaceable, along a mast of a drilling apparatus. The base carriage can be movable in any suitable manner and, in particular, can be coupled to a drilling drive. In particular, according to a further development of the invention, it is advantageous that the base carriage has, for holding on at least one chain, at least one tubular chain quiver which extends along the base carriage and is open upwards. Thus, for coupling, the base carriage can be attached to at least one chain, preferably to at least two spaced-apart chains, for example to a drill drive carriage. When the base carriage moves downward, it can reach upto a lower stop area on the mast, wherein when the drill drive carriage moves further, for example, the collapsing chain can be efficiently accommodated in the tubular chain quiver. According to the number of chains, the same number of chain quivers are provided. In these quivers, the chain can be properly picked up and mounted.

Furthermore, it is preferred that a fastening member for fastening the chain is arranged in a lower region of the chain quiver. In particular, a releasable fastening can be provided.

A further advantageous embodiment of the invention is that at least one mounting foot is arranged on the base carriage, which is preferably mounted in a resilient manner to be displaceable in a vertical direction. By means of such a mounting foot, a certain buffering can be achieved when the base carriage is placed down on a stop area or on the floor.

According to a further embodiment of the invention, it is particularly appropriate that the resiliently-mounted mounting foot is connected to the fastening member in the chain quiver. Overall, a buffered or spring-mounted chain suspension can thus be achieved.

The invention further comprises a drilling machine with a carrier unit and a mast arranged thereon, on which a rotary drilling drive for rotationally driving the drilling tool with a drill flight, in particular a Kelly auger, is mounted, wherein a device for reaming according to the invention is arranged on the mast. With such a drilling machine, which can also be referred to as an earth auger machine, and which is used, in particular for drilling holes in the ground for foundation piles, the above-described advantages can be achieved when using a device for reaming. In particular, an efficient reaming of a Kelly auger, which usually has a length of between 2 to 6 meters, can be reliably and efficiently cleared of adhering soil material.

The invention further comprises a method for reaming a flight gap of a drill flight of a drilling tool, in particular a Kelly auger, of adhering soil material, wherein a device according to the invention is used for reaming. In particular, in discontinuous drilling with a Kelly auger, in which the Kelly auger is repeatedly pulled out of a borehole to empty the auger and is lowered again into the borehole after subsequent reaming, efficient emptying can be achieved by reaming the drill flight with the device according to the invention. Thus, the advantages described above can be achieved with such a method.

The invention enables efficient reaming of a drilling auger so that the otherwise customary free-shaking of the auger can be dispensed completely or to a large extent. During free-shaking, metal parts strike against each other, which is associated with a corresponding sound emission. The invention thus also considerably reduces noise generation at the construction site.

Figure 2:
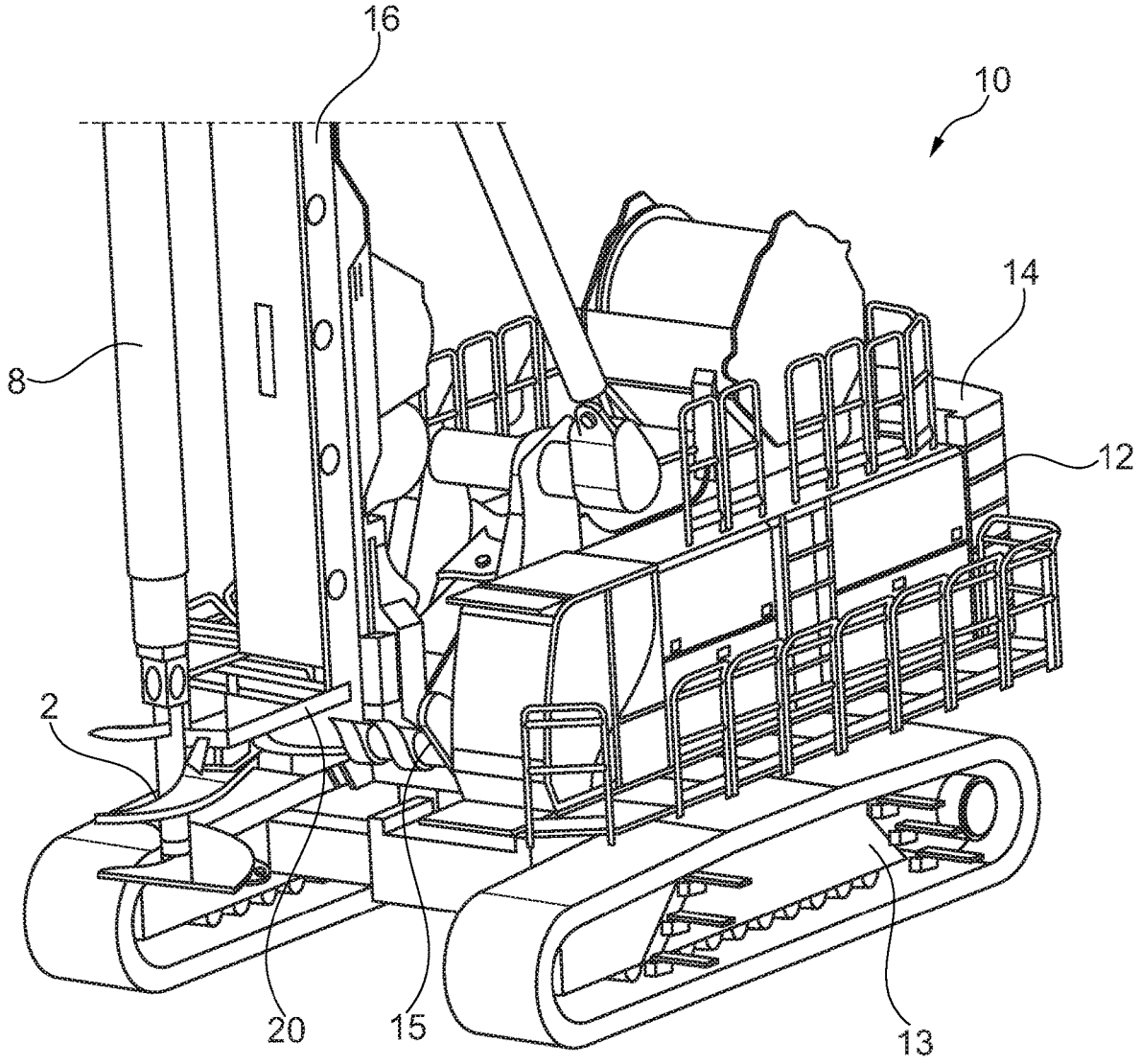
Figure 3:
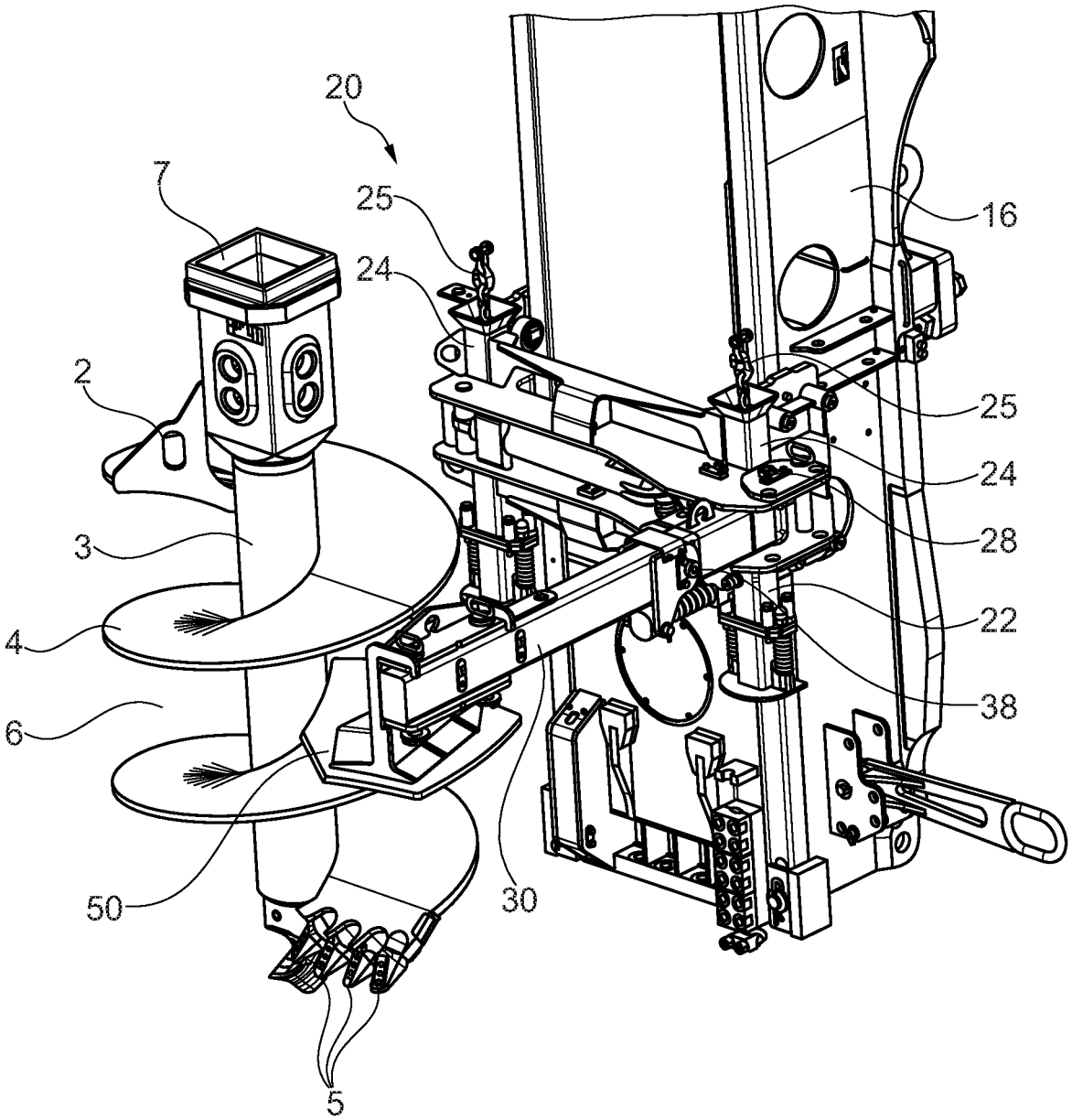
Figure 4:
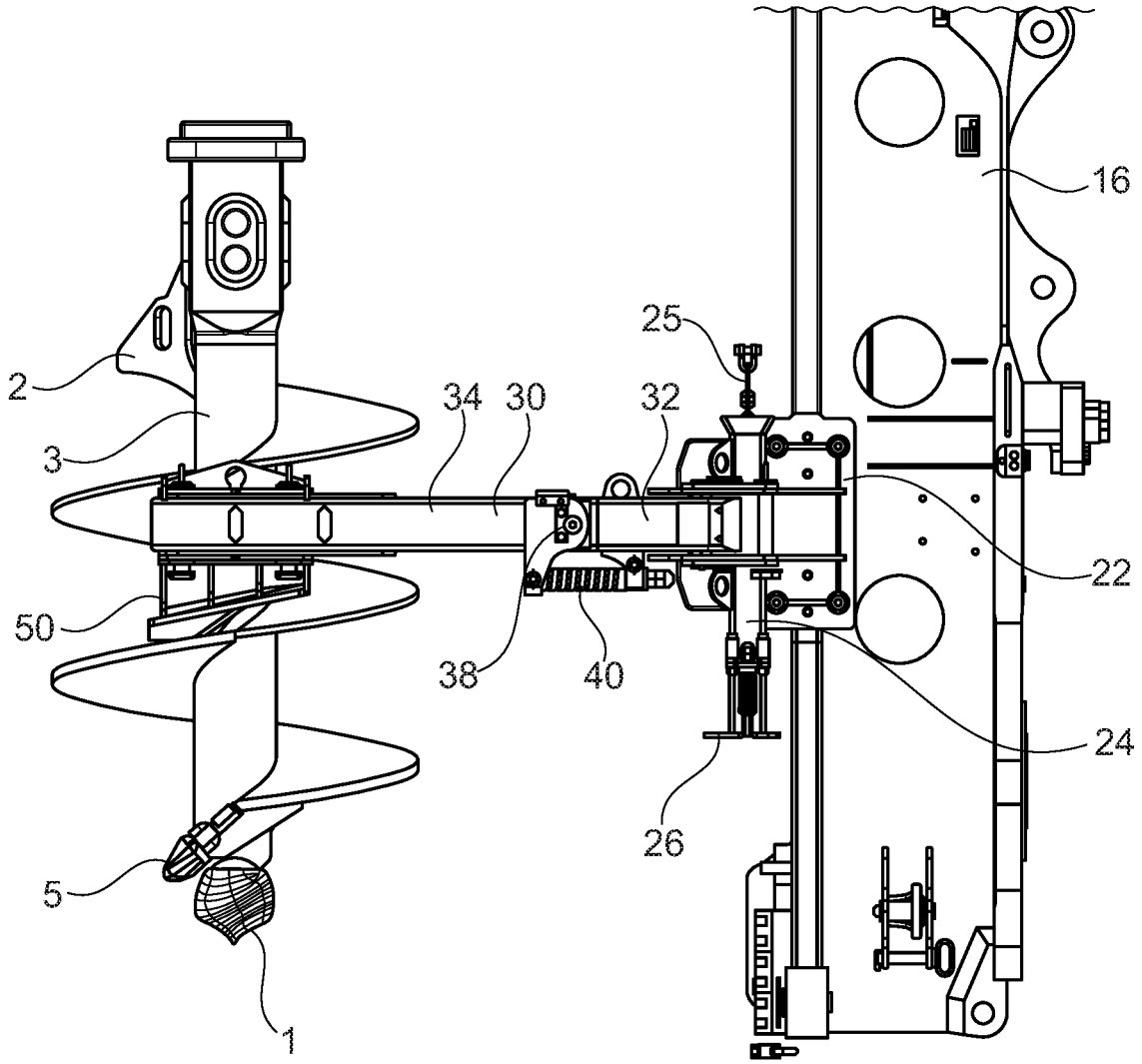
Figure 5:
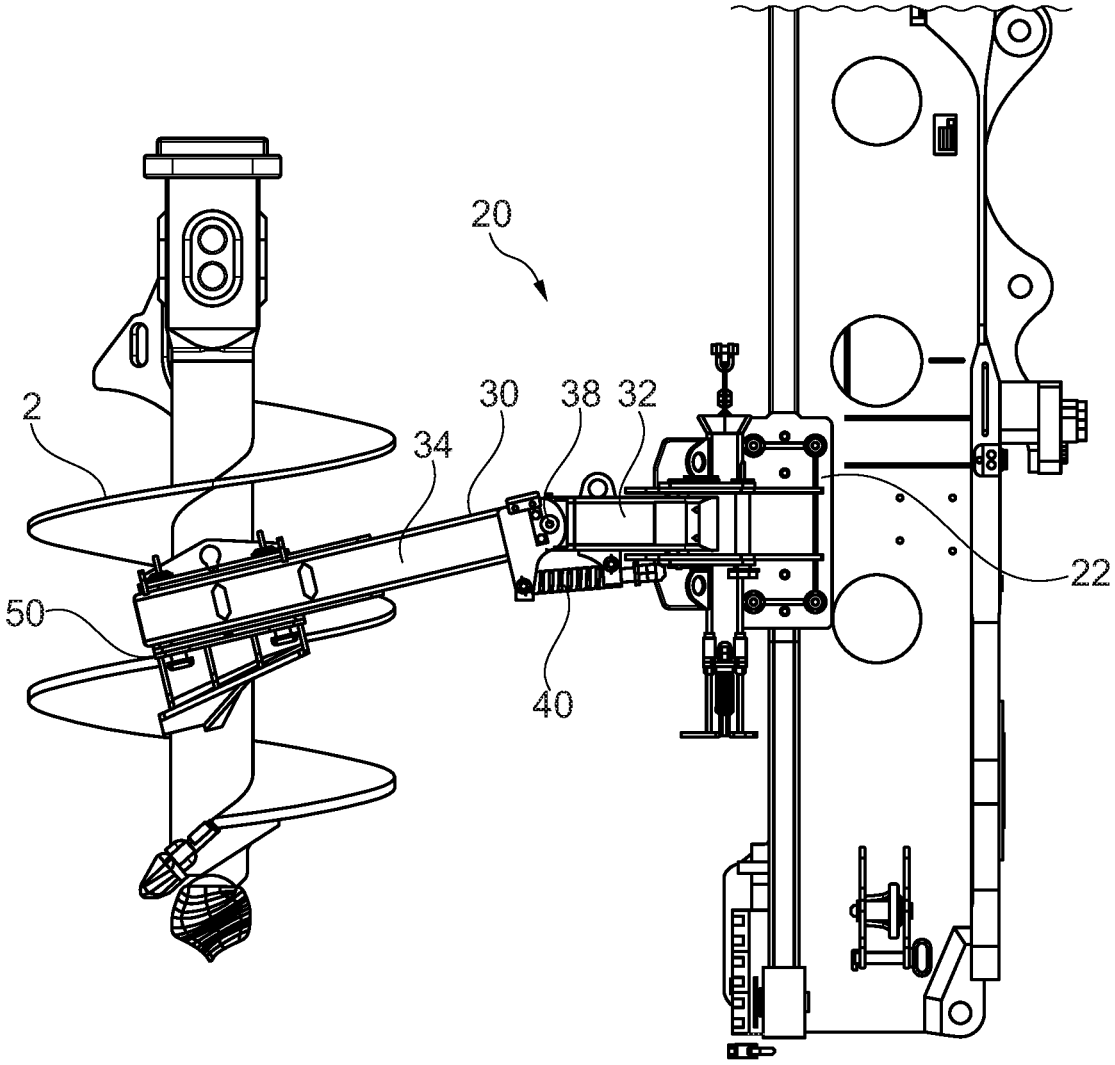
Figure 6:
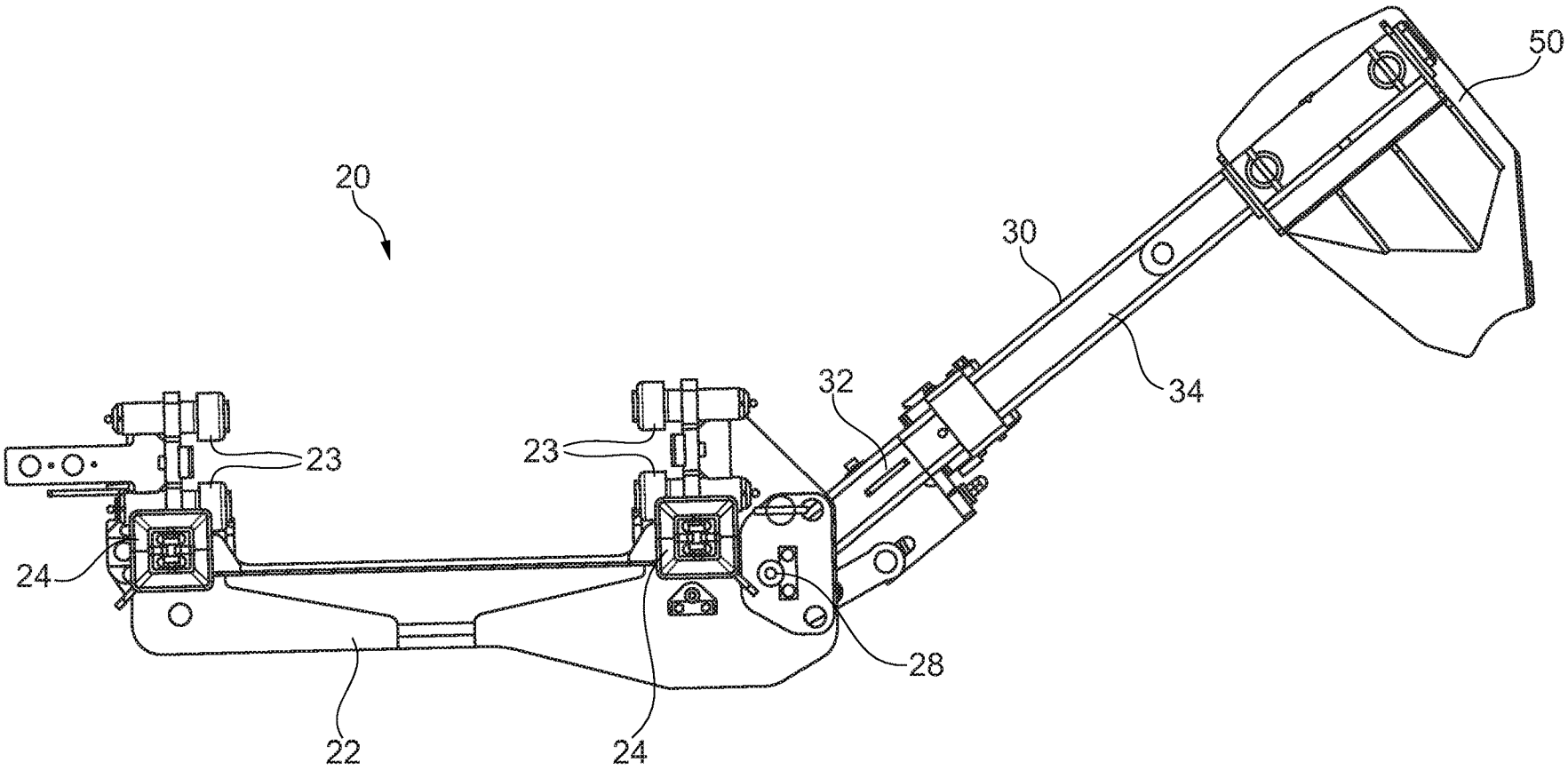
Figure 7:
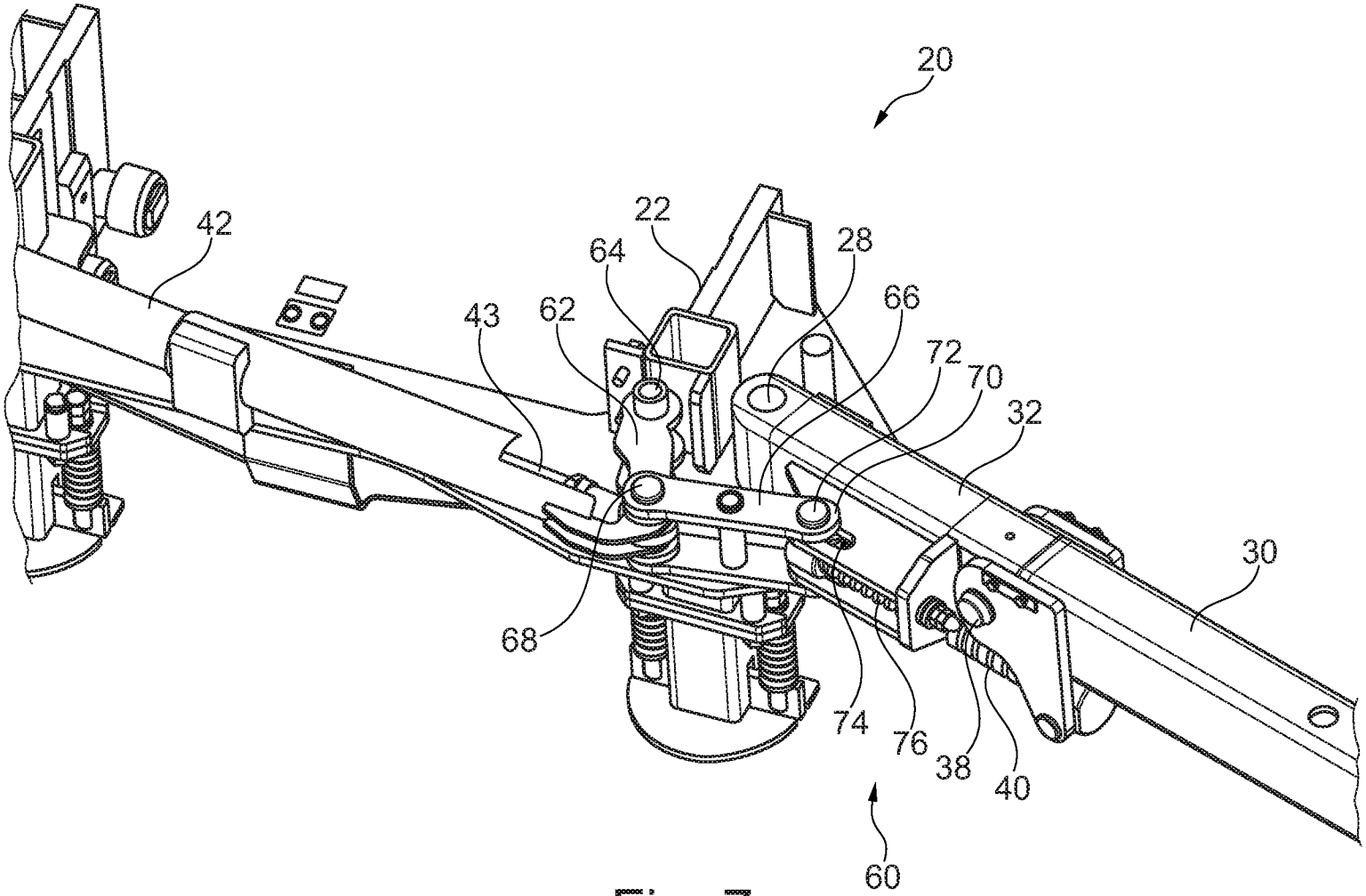
Figure 8:
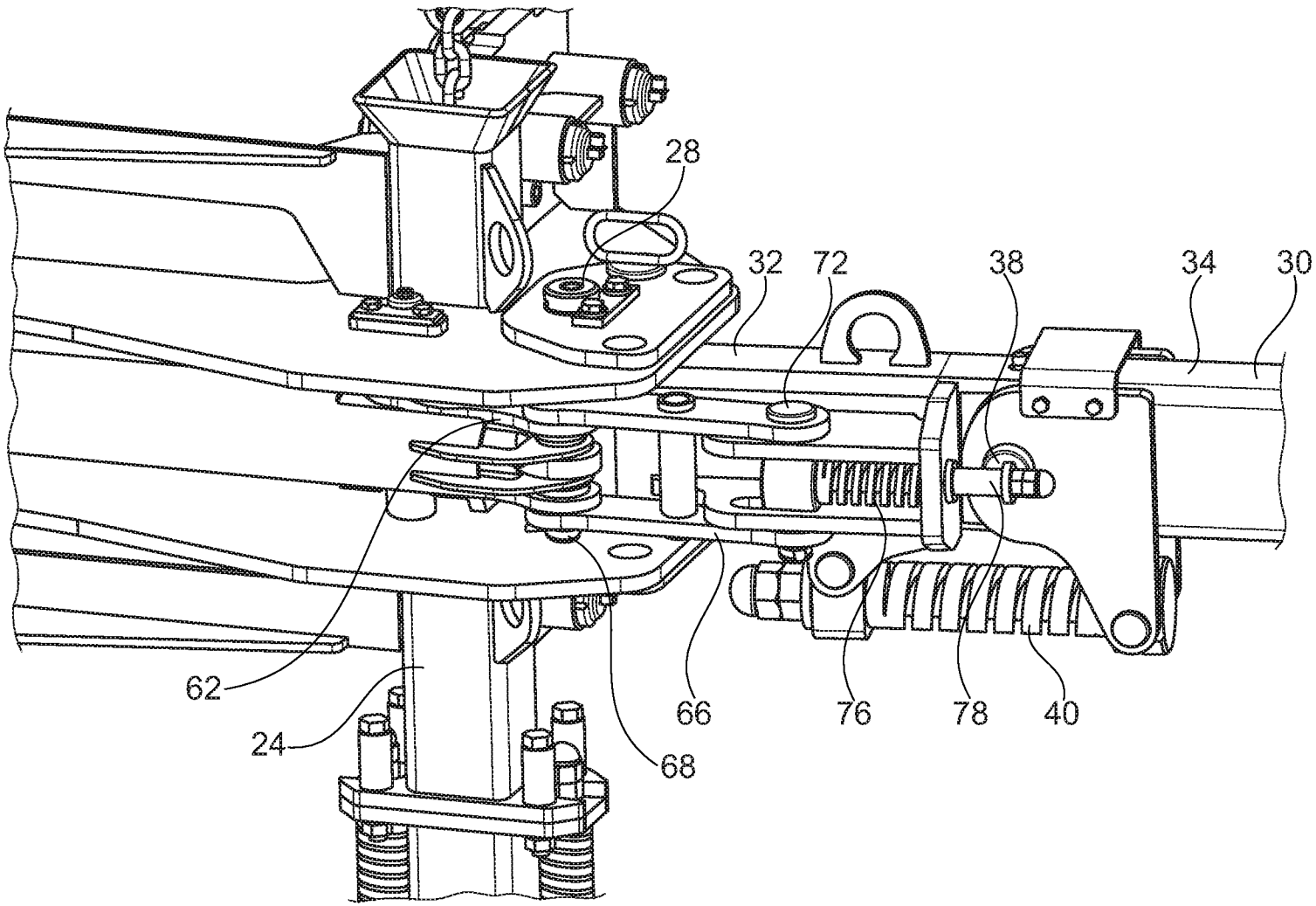
Figure 9:
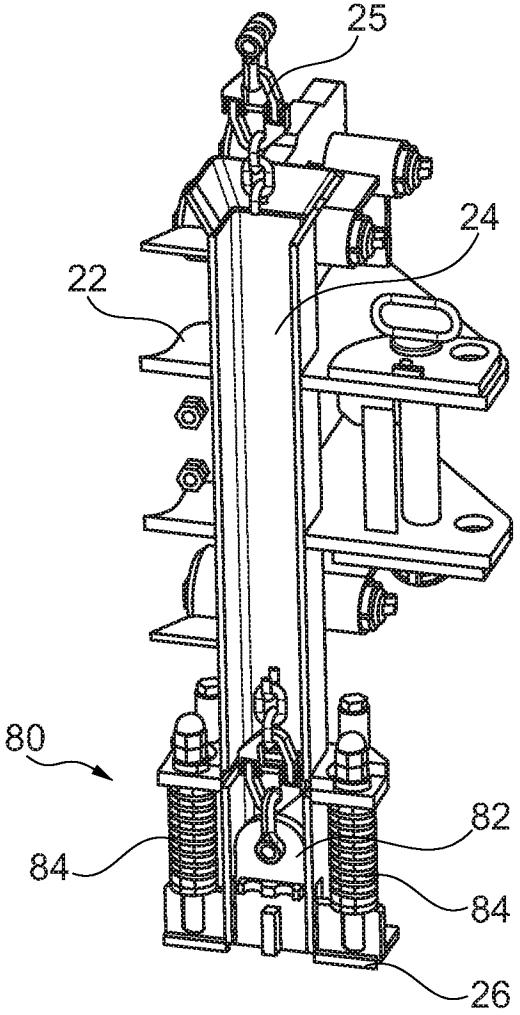
Figure 9:
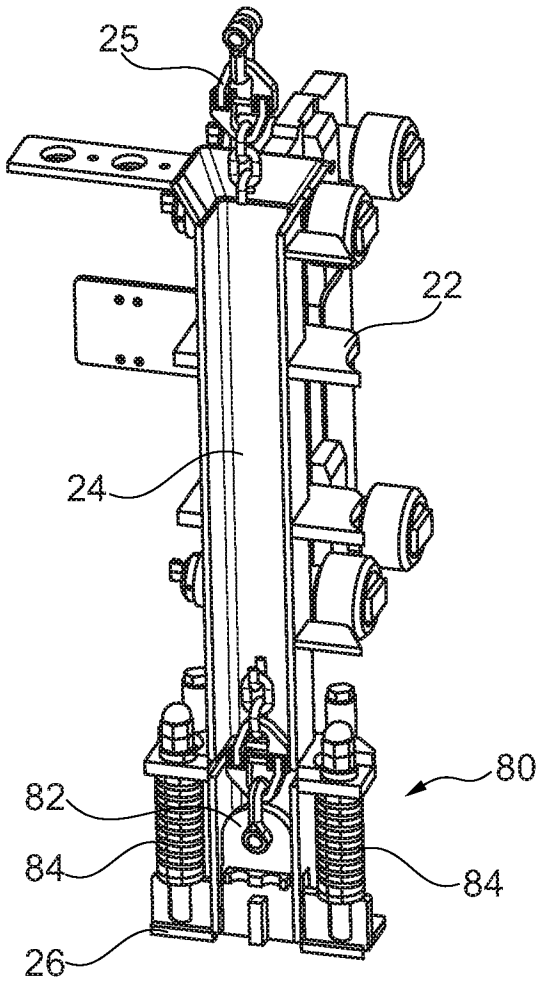

The invention is further described below with reference to a preferred exemplary embodiment, which is shown schematically in the drawings. Shown are in:

FIG. 1 perspective view of a drilling apparatus having a device for reaming according to the invention;

FIG. 2 an enlarged view of a lower section of the drilling apparatus of FIG. 1;

FIG. 3 an enlarged perspective detail view of a device for reaming according to the invention when engaging a Kelly auger;

FIG. 4 a side view illustrating FIG. 3;

FIG. 5 a side view of the device for reaming of FIG. 4 in a deflected position;

FIG. 6 another schematic detail view of a device according to the invention from above with a reaming element in the retracted position;

FIG. 7 detailed perspective view of a lever mechanism on the device for reaming according to the invention;

FIG. 8 another detailed view of the lever mechanism according to FIG. 7; and FIG. 9 partial sectional perspective views of two chain quivers on the device for reaming according to the invention.

The invention is described below with reference to a drilling apparatus 10, which is shown schematically in FIGS. 1 and 2. The drilling apparatus 10 comprises a carrier unit 12, which in the embodiment shown is configured to be mobile with an undercarriage 13, which is configured with a crawler chassis, and an upper carriage 14, which is rotatably mounted thereon. A mast 16, which is oriented essentially vertically during operation, is mounted on the carrier unit 12 so that it can be angled via an articulation mechanism 15. The mast 16 is configured as a so-called leader with a front linear guide along which a drive carriage 17 with a rotary drilling drive 18 is displaceably guided. For displacing the drive carriage 17, a feed drive not shown in more detail is provided, which can be configured by a feed winch or by a linear actuating cylinder.

Through an annular drive element of the rotary drill drive 18, which can also be referred to as a power rotary head or drill table, a schematically indicated kelly bar 8 with outer axial drive bars (not shown) is passed. The kelly bar 8 may be of telescopic design and is suspended from the mast 16 in a vertically adjustable manner via a cable. A drilling tool 2 is torque proof attached to the lower end of the kelly bar 8, which in the illustrated embodiment is configured as a so-called Kelly auger. The drilling apparatus 10 according to the invention is used for creating boreholes in the ground, in particular, for creating foundation piles in the ground.

For reaming the drilling tool 2 of adhering soil material, according to the invention, a device 20 for reaming is arranged on the mast 16 opposite the drilling tool 2.

The device 20 for reaming according to the invention is explained in greater detail below in conjunction with FIGS. 3 and 4. The device 20 comprises a base carriage 22 which, like the drive carriage 17, can be guided linearly displaceably on the same guide of the mast 16. The base carriage 22 comprises two lateral sleeve-shaped chain quivers 24, in which upwardly extending chains 25 are fastened. The chains 25, which are only partially shown in FIGS. 3 and 4, serve to connect and suspend the base carriage 22 to the drive slide 17, which is located above it and is not shown in FIGS. 3 and 4. On an underside of the base carriage 22, the chain quivers 24 can be terminated with a plate-shaped mounting foot 26.

A support arm 30 is arranged on a front side of the base carriage 22, which has a rod-shaped actuator 34 that is adjustably mounted on a base member 32. The base member 32 is mounted on the base carriage 22 so as to be pivotable about a pivot axle 28, the pivot axle 28 being oriented parallel to the longitudinal or drilling axis of the drilling tool 2.

Via a deflection axis 38 oriented transversely thereto, which is oriented, in particular orthogonally to the drilling axis, the actuator 34 of the support arm 30 is mounted deflectably in a substantially vertical direction. A reaming element 50 is attached to the free end of the support arm 34, which element is configured to engage in a helix flight gap 6 on a drill flight 4 of the drilling tool 2. The drill flight 4 extends with some turns along a tubular drilling shaft 3. A pilot tip 1 is arranged at the lower end of the drilling shaft 3. At the lower end of the drill flight 4, removal teeth 5 are arranged in a manner known per se for removing soil material.

Via a square-end connection 7 at the upper end of the drill shank 3, the drilling tool 2 can be detachably and torque proof connected to the kelly bar 8 described above, which is not shown in FIGS. 3 to 5. The deflectability of the reaming element 50 on the support arm 30 is illustrated clearly in FIG. 5. During an axial displacement of the drilling tool 2 along the drilling axis, the actuator 34 of the support arm 30 can follow the vertical movement of the drilling tool 2 to a certain extent by deflecting the actuator 34 about the deflection axis 38.

The actuator 34 of the support arm 30 is held in a substantially horizontal basic position by a bias spring 40 on the underside of the support arm 30. When the drilling tool 2 moves downward, the support arm 30 can thus follow the vertical movement to a certain extent by deflecting downward about the deflection axis 38 by compressing the bias spring 40. In a corresponding manner, the support arm 30 can also follow a vertical movement of the drilling tool 2 upwards to a certain extent, wherein in this case the actuator 34 is pivoted upwards about the deflection axis 38 and the bias spring 40 is stretched.

In FIGS. 3 to 5, the support arm 30 with the reaming element 50 at the free end is shown in a reaming position in which the reaming element 50 engages in the flight gap 6 of the drill flights 4 of the drilling tool 2. The support arm 30 can be pivoted radially outward from this reaming position about the pivot axle 28 relative to the drilling tool 2 into a retracted position, which is shown schematically in FIG. 6. The support arm 30 with the base member 32 and the actuator 34 is pivoted about the axle 28, by means of which the base member 32 is pivotably mounted on the base carriage 22.

In the illustration according to FIG. 6, guide rollers 23 are further discernible on the base carriage 22 of the device 20, by means of which the base carriage 22 is displaceably guided on guide bars of the mast 16 of the drilling apparatus 10.

A lever mechanism 60 with an actuating element 42 in the form of an actuating cylinder can be provided for pivoting the support arm 30 between the reaming position and the retracted position, which will be described in more detail below in conjunction with FIGS. 7 and 8. At the front of the base carriage 22, an approximately horizontally oriented actuating cylinder is arranged in an articulated manner as an actuating element 42. A piston 43 which can be extended from the actuating cylinder, in particular a hydraulic cylinder, is connected in an articulated manner to a guide lever 62 which is pivotably mounted on the base carriage 22 via a joint pin 64. At the connection point between the guide lever 62 and the piston 43, a coupling lever 66 is articulated via a link pin 68. At an opposite end of the coupling lever 66, the latter is pivotably and displaceably mounted along a longitudinal axis of the support arm 30 via a coupling joint 70 with a joint pin 72 in an elongated hole 74. The joint pin 72 can be biased in the elongated hole 74 via a tension spring 76 with a guide pin 78. The tension spring 76 holds the joint pin 72 in position but allows some movement if the support arm 30 encounters resistance during operation and the spring tension force is overcome. This protects the assembly from damage.

When the piston 43 is extended from the actuating cylinder 42, the support arm 30 with the base member 32 and the actuator 34 is pushed into a retracted position, which is spaced from the drilling tool 2. By retracting the piston 43 into the actuating cylinder, the support arm 30 is pivoted inwards from the position shown in FIG. 8 via the lever mechanism 60 in a substantially horizontal direction into the flight gap 6 on the drilling tool 2 to a reaming position, as shown in FIGS. 3 to 5.

During axial displacement of the drilling tool 2 along the drilling axis, the support arm 30 can be deflected about the deflection axis 38 so that damages are avoided, provided that unintended axial travel occurs to some extent with the reaming element 50 still pivoted in.

In the schematic cross-sectional view of FIG. 9, the arrangement and suspension of the base carriage 22 via the two lateral chains 25 is shown in greater detail. The chains 25 extend in each case through a sleeve-shaped chain quiver 24 to a lower fastening member 82 of a fastening arrangement 80 at the lower end of the respective chain quiver 24. The fastening member 82, which is mounted displaceably in a vertical direction on the base carriage 22. Via lateral damping springs 64, the fastening member 82 can be resiliently and linearly displaceably mounted for the respective chain 25.

When the drive carriage 17 and the base carriage 22 of the device 20 for reaming are moved towards one another, the chain links of the chains 25 within the sleeve-shaped chain quiver 24 can respectively fold or push together. When the drive carriage 17 is moved rapidly upward, vertical impacts on the base carriage 22 and thus also on the support arm 30 can be avoided or damped, which can also serve to protect the reaming element 50 and the drilling tool 2, under die assumption that the reaming element 50 is in the reaming position. Damping is also achieved when the base carriage 22 impacts on the ground. This can occur, for example, when the drive carriage 17 is relatively close to the ground and the support arm 30 is pivoted out of the flight of the drilling tool 2. In doing so, the base carriage 22 may drop downward to a certain distance and impact on the ground.

The invention claimed is:

1. A device for reaming a flight gap of a drill flight of a drilling tool, comprising - a base carriage displaceably mounted along a mast of a drilling apparatus, the base carriage being attached to a drill drive carriage by coupling the base carriage to the drill drive carriage with at least one chain, a reaming element which is configured to engage in the flight gap of the drilling tool, wherein soil material adhering to the drilling tool can be scraped off by the reaming element when the drilling tool is rotated, and a support arm on which the reaming element is held, and which is mounted movably relative to the base carriage between a retracted position, in which the reaming element is spaced apart from the drilling tool, and a reaming position, in which the reaming element engages in the flight gap for reaming soil material, wherein the support arm is pivotally mounted between the retracted position and the reaming position about a pivot axle which is oriented substantially parallel to a drilling longitudinal axis of the drilling tool, the support arm is additionally mounted on the base carriage in a direction parallel to the drilling longitudinal axis of the drilling tool, so as to be deflectable from a basic position, and the support arm is held in the basic position with a biasing force by means of at least one bias device.

2. The device according to claim 1, wherein a base member and an actuator of the support arm are provided, wherein the actuator is displaceably and adjustably held on the base member, wherein the support arm is pivotally mounted on the base carriage about the pivot axle.

3. The device according to claim 2, wherein the actuator of the support arm is mounted on the base member, so as to be pivotable about a deflection axis which is oriented transversely to the drilling longitudinal axis.

4. The device according to claim 2, wherein a bias spring is arranged between the base member and the actuator of the support arm.

5. The device according to claim 1, wherein the support arm can be adjusted between the retracted position and the reaming position by means of an actuating element, comprising a hydraulic cylinder.

6. The device according to claim 5, wherein the actuating element is arranged on the base carriage and is connected to the support arm via a lever mechanism.

7. The device according to claim 6, wherein the lever mechanism comprises a guide lever, which is connected in an articulated manner to the base carriage and to a piston of the actuating element, and a coupling lever, which is connected in an articulated manner to the piston and/or to the guide lever and to the support arm via a coupling joint.

8. The device according to claim 7, wherein p1 the coupling joint between the support arm and the coupling lever comprises a joint pin, which is mounted linearly displaceably in an elongated hole on the support arm.

9. The device according to claim 8, wherein the joint pin is resiliently mounted in the elongated hole.

10. The device according to claim 1, wherein the base carriage comprises at least one tubular chain quiver which extends along the base carriage and is open towards the top for holding the at least one chain.

11. The device according to claim 10, wherein a fastening member for fastening the chain is arranged in a lower region of the chain quiver.

12. The device according to claim 1, wherein at least one fastening member is mounted on the base carriage in a resilient manner to be displaceable in a vertical direction.

13. A drilling apparatus comprising a carrier unit and a mast arranged thereon, on which a rotary drilling drive for rotationally driving a drilling tool with a drill flight is mounted, the drilling tool comprising a Kelly auger, wherein a device for reaming according to claim 1 is arranged on the mast.

14. A method for reaming a flight gap of a drill flight of a drilling tool;

comprising a Kelly auger, from adhering soil material, wherein a device according to claim 1 is used for reaming.

* * * * *